US007124603B2

(12) United States Patent
Bianco

(10) Patent No.: US 7,124,603 B2
(45) Date of Patent: Oct. 24, 2006

(54) ICE RETAINING SHOT GLASS SYSTEM

(76) Inventor: Mark Lo Bianco, Fantastic Fabrics, 4R Bethpage Ct., Hicksville, NY (US) 11801

( * ) Notice: Subject to any disclaimer, the term of this patent is extended or adjusted under 35 U.S.C. 154(b) by 130 days.

(21) Appl. No.: 10/962,243

(22) Filed: Oct. 8, 2004

(65) Prior Publication Data

US 2006/0112722 A1 Jun. 1, 2006

(51) Int. Cl.
*F25D 19/00* (2006.01)

(52) U.S. Cl. ..... 62/457.3; 62/530

(58) Field of Classification Search ..... 62/457.1, 62/457.2, 457.3, 457.4, 371, 530, 460
See application file for complete search history.

(56) References Cited

U.S. PATENT DOCUMENTS 155,213 A * 9/1874 Woolfolk ..... 62/400
2,594,127 A 4/1952 Collier
3,059,452 A * 10/1962 Griffin ..... 62/457.2
3,807,194 A * 4/1974 Bond ..... 62/457.4
4,091,632 A 5/1978 Marchewka et al.
4,478,346 A * 10/1984 Spong ..... 220/711
4,638,645 A * 1/1987 Simila ..... 62/457.1
4,823,974 A * 4/1989 Crosser ..... 62/457.3
5,250,315 A 10/1993 Loew et al.
D363,854 S 11/1995 Katz
D369,114 S 4/1996 Davidov
D384,859 S 10/1997 Cundieff
5,772,065 A 6/1998 Kalamaras
D448,241 S 9/2001 Morris, Jr.
6,557,370 B1 * 5/2003 Gano, III ..... 62/457.5
6,761,347 B1 7/2004 Moore

OTHER PUBLICATIONS

Arctic Iceshot on the internet www.iceshots.com.
Arctic iceshot is a Swedish product, sold at www,getlostmagazine.com.

* cited by examiner

*Primary Examiner*—Melvin Jones
(74) *Attorney, Agent, or Firm*—Richard L. Miller

(57) ABSTRACT

A shot glass system has means for holding frozen water, i.e. ice against the alcohol-retaining walls comprising circumferential detents and lips placed within a chamber which is formed adjacent the walls.

8 Claims, 1 Drawing Sheet

ICE RETAINING SHOT GLASS SYSTEM

BACKGROUND OF THE INVENTION

1. Field of the Invention

The present invention relates to double-walled glasses and more particularly to shot glasses enclosing ice or cooling means within their walls.

2. Description of the Prior Art

Numerous innovations for Ice Shot Glasses have been provided in the prior art that will be described. Even though these innovations may be suitable for the specific individual purposes to which they address, accordingly they differ from the present invention.

A FIRST EXAMPLE, U.S. Pat. No. 2,594,127 to Collier teaches an ice cube tray comprising a vessel including top and downwardly directed side walls, spaced cups depending from said top wall defining ice block molds, the depth of said cups being no greater than the height of said side walls, and partitions intermediate certain of said cups attached to the lower face of said top wall and the inner faces of opposed side walls.

A SECOND EXAMPLE, U.S. Pat. No. 4,091,632 to Marchewka, et al. teaches the beverage cooling device includes a semi-flexible plastic container and a liquid foodstuff which is totally enclosed within the container. The container and its contents are adapted to be frozen and utilized as a beverage cooling device. While the liquid foodstuff is in the frozen state within the container, the container may be broken open to remove the frozen liquid to permit the same to be used simultaneously as a coolant and as a flavoring for the beverage. Alternatively, the frozen foodstuff can be consumed directly. On the other hand the device can be allowed to cool within a drinking vessel to cool a liquid or beverage therein and then refrozen for reuse.

A THIRD EXAMPLE, U.S. Pat. No. 5,250,315 to Loew. et al. teaches a mold for making shot-sized drinking glasses formed of ice having a substantially cylindrical outer wall having an upper end situated in an upper horizontal plane and a lower end situated in a horizontal lower plane, and a downwardly-opening cup-shaped inner wall comprising an inner side wall portion and an inner top wall portion, the latter being situated below the upper plane in which the upper end of the outer wall is situated. Rack apparatus for making a plurality of shot-size drinking glasses formed of ice includes a multi-cavity grid in combination with a cooperating frame and a plurality of molds. Apparatus for facilitating the use of shot-size drinking glasses formed of ice include one or more holding members formed of flexible sheet material in combination with a caddy including a recess for positioning the holding member with respect to the glass.

A FOURTH EXAMPLE, U.S. Pat. No. D363,854 to Katz shows the ornamental design for a shot glass.

A FIFTH EXAMPLE, U.S. Pat. No. D369,114 to Davidov shows the ornamental design for a helmet shot glass.

A SIXTH EXAMPLE, U.S. Pat. No. D384,859 to Cundieff shows the ornamental design for a shot glass.

A SEVENTH EXAMPLE, U.S. Pat. No. 5,772,065 Kalamaras teaches a shot glass is formed with a sloping, slightly tapered side wall. A curved cup bottom wall extends across the bottom of the shot glass and is spaced upward from the bottom edge of the shot glass side wall. The cup bottom wall has a thicker central portion and a thinner annular peripheral portion, and upper and lower surfaces of the cup bottom wall are formed with different radii of curvature. The bottom surface has a larger radius and the upper surface has a smaller surface for forming a lens. The base has a base wall and a peripheral side wall which extends upward from the base wall. A thin peripheral ring extends downward from outer edges of the base wall to form a foot. The cylindrical side wall of the base has a flat upper surface on which is formed an energy directing bead. The side wall of the base fits inside a bottom edge of the shot glass, and the energy directing bead contacts an inner step in the shot glass side wall slightly above the lower edge. When the base and shot glass are pressed together and ultrasonic energy is applied, the energy-directing bead focuses energy to soften the step and the flat wall and fuse the two together, sealing the base and shot glass. Objects are placed between the base wall and cup bottom wall in the cavity formed therebetween before sealing the base to the shot glass. One base wall has upward formed lenticules, which lift and tip precision-cut confetti shapes, which are magnified by the cup bottom wall.

AN EIGHTH EXAMPLE, U.S. Pat. No. D448,241 to Morris, Jr. shows the ornamental design for a shot glass.

A NINTH EXAMPLE is found in www.iceshots.com which sells a hollow mold from which one may produce a shot 'glass' made of frozen foodstuffs itself. Although the mold is hollow in the typical fashion of molds, a frozen and edible shot container itself is minimally relevant to the instant invention.

A TENTH EXAMPLE if found at www.get . . . That website sells products which are also minimally related to the instant invention. Its "Arctic Ice Shot" freezes a solid shot 'glass' which is itself edible once the liquor is gone.

Of the prior art, Loew et al is the most closely related. Its failing arises in that gravity will pull the frozen coolant away from the alcohol. Thus, it does not do a proper job.

Contrarily, the instant invention provides at least one lip that holds the ice to the alcohol retaining wall far longer than does the prior art.

SUMMARY OF THE INVENTION

AN OBJECT of the present invention is to provide an ice shot glass that avoids the disadvantages of the prior art.

ANOTHER OBJECT of the present invention is to provide an ice shot glass that is simple and inexpensive to manufacture.

STILL ANOTHER OBJECT of the present invention is to provide an ice shot glass that is simple to use.

BRIEFLY STATED, STILL YET ANOTHER OBJECT of the present invention is to provide an ice holding structure that can hold ice to the liquor-retaining wall of a shot glass far longer than can any of the prior art.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows.

A MARSHALLING OF REFERENCE NUMERALS UTILIZED IN THE DRAWING

| | |
|---|---|
| 10 | ice shot glass |
| 20 | outside vertical wall |
| 22 | base |
| 24 | ice-retaining curvature |
| 26 | lip |
| 30 | cap |
| 32 | cap side retainer |
| 40 | circumferential detent |
| 42 | freezable liquid container |
| 50 | alcohol containing shot glass container |
| 52 | fill line indicia |

DETAILED DESCRIPTION OF THE PREFERRED EMBODIMENT

Figure 1:
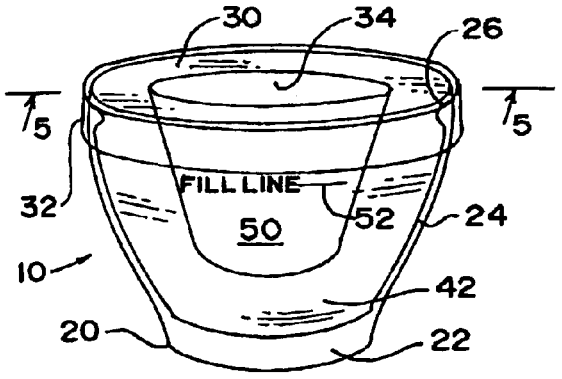
FIG. 1 PRIOR ART
FIG. 1 is a diagrammatic perspective view illustrating a first embodiment of the present invention.

Referring now to the Figures, in which like numerals indicate like parts, and particularly to FIG. 1, an alcohol-retaining "shot" glass having containing space 50 therewithin is shown having alcohol-retaining shot glass side wall 34. The instant ice-retaining shot glass system 10 encloses the otherwise-normal shot glass side wall 34 with an exterior wall 20, base 22 and a separate cap 30. Snugly fitting cover or cap 30 with vertical exterior circumferential retaining wall 32 is placed over both the exterior wall 20 and normal shot glass wall 34—leaving the alcohol container 50 open.

A space or chamber 42 is formed between circumferential exterior wall 20 and normal shot glass wall 34. Within the chamber 42 is room for a freezable liquid such as water. When filled to the fill line indicia 52 and frozen, the resulting ice directly abuts the circumferential interior wall 36 of shot glass wall 34. In doing so, the frozen water i.e. ice cools the alcohol placed inside the circumferential shot glass wall 34.

Figure 3:
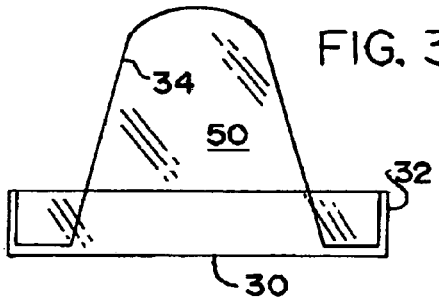
FIG. 3 is a diagrammatic side elevational view of the cap component of the present invention.

FIG. 3 shows a cap 30 having circumferential shot glass walls 34 integral with it. Thus, the alcohol containing space 50 is part of the cap 30. The placing of cap 30 by a user over exterior walls 20 causes ice-retaining chamber 42 to instantly form. Circumferential cap retaining wall 32 helps to hold cap 30 onto the outside of wall 20.

Note that exterior walls 20 can be shaped with curvature 24 so to help in supporting and maintaining the interior ice in working position.

Figure 6:
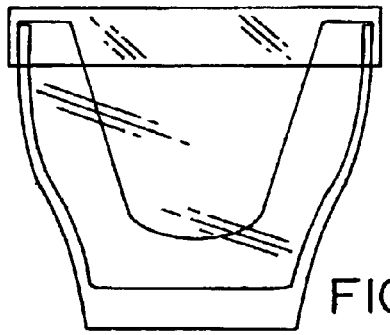
FIG. 6 is a diagrammatic side elevational view of the prior art.

The above system is generally found in the prior art and is shown in FIG. 6.

Figure 5:
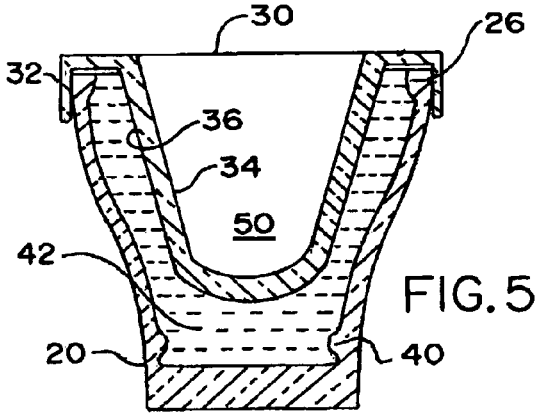
FIG. 5 is a diagrammatic cross sectional view taken on line 5—5 of FIG. 1.
Figure 2:
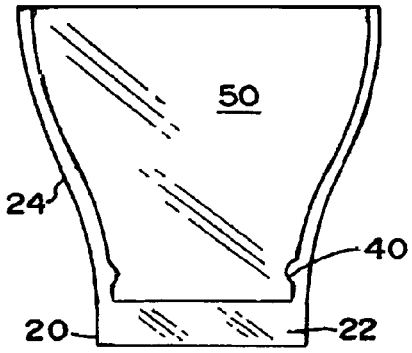
FIG. 2 is a side elevational view of a second embodiment of just the shot glass portion of the present invention provisioned to capture the ice frozen therein by a circumferential detent located at the bottom interior of the glass.
Figure 4:
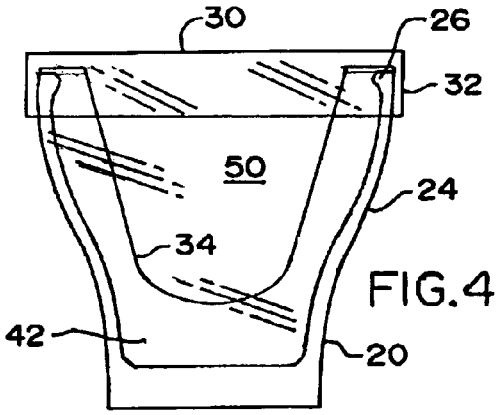
FIG. 4 is a side elevational view of a third embodiment of the shot glass with the cap installed thereon of the present invention provisioned to capture the ice frozen therein by a circumferential lip located at the rim interior of the glass.

The instant invention additionally adds novel ice-holding structures to the external wall 20. A first embodiment is both lip 26 and detent 40 placed upon circumferential wall 20. A second such embodiment of al ice holding structure is a circumferential detent 40 located (FIG. 2) at the bottom of the exterior wall 20 near base 22. Still a third such embodiment is a circumferential lip 26 (FIG. 4) located near the top of wall 20.

In operation, cap 30 having shot glass side walls 34 defining an alcohol-retaining area 50 is placed over exterior walls 20 to form an ice-retaining chamber 42. Cap 30 has vertical walls 32 to maintain cap 30 in place over and against circumferential walls 20.

Water then fills chamber 42 and is frozen in place.

Lip 26 and/or circumferential detent 40 helps to retain the ice in place even as the ice melts and becomes slushy. Thus, the instant ice shot glass system 10 may be repeatedly picked up and set down again upon its base 22 while still maintaining cold the alcohol placed within area 50.

It is to be noted that the third embodiment, has an additional benefit of permitting the user to selectively allow the ice chamber to be removable from the shot glass if he/she choose not to sufficiently fill the ice-retaining chamber 42 with respect to the fill line indicia 52 on the shot glass, in which case the ice will not come in contact with the circumferential lip 26 (FIG. 4) located near the top of wall 20.

It will be understood that each of the elements described above, or two or more together, may also find a useful application in other types of constructions differing from the types described above.

While the invention has been illustrated and described as embodiments of the instant Ice Shot Glass, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An ice retaining shot glass system, comprising:

a) an exterior circumferential wall mounted upon a base;

b) a cap having a circumferential place retaining side wall and a molded circumferential shot glass alcohol-retaining wall;

c) said alcohol-retaining wall generally centrally placed within said cap;

d) an ice retaining chamber formed when said cap is placed upon said exterior circumferential wall; and e) at least one circumferential ice holding structure placed into said exterior circumferential wall, wherein said circumferential ice holding structure is a circumferential detent.

2. The ice retaining shot glass system of claim 1, wherein said exterior circumferential wall has a fill line indicia thereon.

3. An ice retaining shot glass system comprising:

a) an exterior circumferential wall mounted upon a base;

b) a cap having a circumferential place retaining side wall and a molded circumferential shot class alcohol-retaining wall;

c) said alcohol-retaining wall generally centrally placed within said cap;

d) an ice retaining chamber formed when said cap is placed upon said exterior circumferential wall; and e) at least one circumferential ice holding structure placed into said exterior circumferential wall, wherein said circumferential ice holding structure is a circumferential lip.

4. The ice retaining shot glass system of claim 3, wherein said exterior circumferential wall has a fill line indicia thereon.

5. An ice retaining shot glass system, comprising:

a) a cap;

b) a shot glass molded into said cap;

c) said cap having a circumferential side wall;

d) an exterior circumferential wall mounted upon a base;

e) an ice retaining chamber formed when said cap is placed upon said exterior circumferential wall; and f) at least one circumferential ice holding structure placed into said exterior circumferential wall, wherein said circumferential ice holding structure is a circumferential detent.

6. The ice retaining shot glass system of claim 5, wherein said exterior circumferential wall has a fill line indicia thereon.

7. An ice retaining shot class system, comprising:

a) a cap;

b) a shot glass molded into said cap;

c) said cap having a circumferential side wall;

d) an exterior circumferential wall mounted upon a base;

e) an ice retaining chamber formed when said cap is placed upon said exterior circumferential wall; and f) at least one circumferential ice holding structure placed into said exterior circumferential wall, wherein said circumferential ice holding structure is a circumferential lip.

8. The ice retaining shot glass system of claim 7, wherein said exterior circumferential wall has a fill line indicia thereon.

* * * * *